United States Patent [19]

Bos

[11] Patent Number: 4,870,398

[45] Date of Patent: Sep. 26, 1989

[54] DRIVE WAVEFORM FOR FERROELECTRIC DISPLAYS

[75] Inventor: Philip J. Bos, Portland, Oreg.

[73] Assignee: Tektronix, Inc., Beaverton, Oreg.

[21] Appl. No.: 105,843

[22] Filed: Oct. 8, 1987

[51] Int. Cl.[4] ..... G09G 3/36

[52] U.S. Cl. ..... 340/784; 340/802; 340/805; 350/332; 350/333

[58] Field of Search ..... 340/784, 802, 805, 789; 350/332, 333

[56] References Cited

U.S. PATENT DOCUMENTS

| | | | |
|---|---|---|---|
| 4,367,924 | 1/1983 | Clark et al. | 350/334 |
| 4,508,429 | 4/1985 | Nagae et al. | 350/350 S |
| 4,548,476 | 10/1985 | Kaneko | 350/350 S |
| 4,638,310 | 1/1987 | Ayliffe | 340/805 |
| 4,645,303 | 2/1987 | Sekiya et al. | 350/332 |
| 4,710,768 | 12/1987 | Takeda et al. | 340/792 |
| 4,715,688 | 12/1987 | Harada et al. | 350/350 S |
| 4,728,947 | 3/1988 | Ayliffe et al. | 340/784 |

OTHER PUBLICATIONS

Lagerwall et al., "Ferroelectric Liquid Crystals for Displays", 1985 International Display Research Conference Proceedings, IEEE, pp. 213–221, (1985).

Shimoda et al, "Optimum Bias Condition for Multiplex Driving of the Chiral Smectic C LCD," Japan Display (1986), pp. 460–462.

*Primary Examiner*—Gerald L. Brigance
*Assistant Examiner*—Richard Hjerpe
*Attorney, Agent, or Firm*—John D. Winkelman; Alan T. McCollom

[57] ABSTRACT

A ferroelectric liquid crystal matrix display drive waveform scheme and circuit are disclosed which produce a resultant waveform at each pixel defined by the intersections of row and column electrodes that varies among three levels during each strobe interval. In a matrix of N rows and M columns, the rows are serially strobed with a strobe waveform that varies through three levels to provide select and non-select strobe signals. During each strobe interval, the column driver circuitry generates three-level and three-phase, time-variant drive waveforms. The circuit can provide up (write) and down (erase) pulses selectively to each pixel of the display using standard twisted-nematic type liquid crystal display drivers. A complex waveform generator provides three-level, three-phase control signals to the supply voltage inputs of the drivers. Timing and synchronizing signals are extracted from the graphics data and timing source outputs to enable the multilevel, multiphase signals to produce the three-phase resultant waveforms at each pixel in a sequence that correctly switches the display state of each pixel in accordance with the data without flicker and with uniform high contrast.

35 Claims, 8 Drawing Sheets

SED 1190 Rows:

| Fr | Ydx | OUTPUT$_X$ |
|---|---|---|
| 0 | 0 | $V_4$ |
| 0 | 1 | $V_{DD}$ |
| 1 | 0 | $V_1$ |
| 1 | 1 | $V_{SSH}$ |

SED 1180 Columns:

| Fr | Xdx | OUTPUT$_X$ |
|---|---|---|
| 0 | 0 | $V_3$ |
| 0 | 1 | $V_{SSH}$ |
| 1 | 0 | $V_2$ |
| 1 | 1 | $V_{DD}$ |

Voltages are adjustable (with exception of $+5=V_{DD}$) to provide drive level needed for the particular LCD being driven.

All drive level conditions are satisfied: Rows: $V_{SSH} \leq V_4 \leq V_1 \leq V_{DD}$
Columns: $V_{SSH} \leq V_3 \leq V_2 \leq V_{DD}$

DRIVE WAVEFORM FOR FERROELECTRIC DISPLAYS

This application contains subject matter in common with commonly-assigned U.S. Pat. application Ser. No. 07/105,842 filed on even date herewith, entitled COMPLEX WAVEFORM MULTIPLEXER FOR LIQUID CRYSTAL DISPLAYS.

BACKGROUND OF THE INVENTION

This invention relates generally to methods and circuitry for driving matrix displays and more particularly to ferroelectric liquid crystal displays.

The idea to use ferroelectric liquid crystals in display devices was proposed by N. Clark and S. Lagerwall, U.S. Pat. No. 4,367,924. The materials used in these devices are smectic C or H liquid crystals. These are material wherein the molecules lie in planes and the molecules are tilted within the planes and rotate in a conical locus about the planar normal. These materials exhibit bi-stability, that is, can be switched between two stable states by reversing the polarity of an externally applied electric field, to make a bi-stable electro-optical device. Chiral smectic C materials (SmC*) further possess a permanent dipole moment that lies in the smectic planes and is normal to the long molecular axis. This dipole moment couples strongly with applied electric fields and allows the rotation angle of the molecules about planar normal to be controlled by applying an electric field parallel to the smectic planes.

A ferroelectric liquid crystal cell is formed by confining a thin layer of the material between two layers of glass. The ferroelectric liquid crystal molecules at the surface of the glass are constrained to be flat against the surface. The director field can thus adopt two uniform states. Electrodes in the form of transparent conductive stripes are applied to the interior surfaces of the sheets of glass to complete the liquid crystal cell. The electrodes form M columns on one surface and N transverse rows on the opposing surface. The intersections of the rows and columns define pixels in an M×N matrix. The pixels are set to a desired display state by applying waveforms to the M rows called "strobe waveforms" and applying waveforms to the N columns called "data waveforms," each consisting of select or non-select data waveforms.

The field applied by the electrodes will be parallel to the smectic planes if the planes are oriented normal to the surfaces of the glass. Clark et al. describe a method for attaining this orientation. The resultant structure provides a liquid crystal display device comprising a matrix of N×M pixels that are switchable between at least two display states. By use of polarizers, the states can be made optically distinguishable.

The ability to make operable ferroelectric liquid crystal matrix display devices work has been demonstrated. A number of problems arise, however, in trying to design a practical, commercially-applicable ferroelectric liquid crystal display. In practice, building a device which is defect free and has "good" bi-stability is a problem. Among the most important considerations is how to drive the display. The forms of applied strobe and data waveforms proposed to date have not provided satisfactory matrix display operation.

Most liquid crystals that have been employed in conventional practice for commercial liquid crystal display devices are twisted nematic-type liquid crystals. Nematic liquid crystals have a positive dielectric anisotropy. Twisted nematic liquid crystal displays can be effectively driven by applying static DC signals to the electrodes. These signal levels are conventionally provided by a fixed resistive-capacitive voltage divider. A typical driver circuit for twisted nematic-type liquid crystal displays is the MSM5260 GSK Model 80 bit LCD dot matrix driver and associated circuitry, manufactured by OKI Electric Industry Co., Ltd., of Sunnyvale, California.

Such a driver typically includes a serial-to-parallel N-bit shift register into which display data (for the column or X driver) and line select data (for the row or Y driver) are input. The shift register outputs the data in parallel to a latch, which passes the data to a N-wide 4:1 analog multiplexer array. Each multiplexer has two select inputs, one of which (FR) is common to all, the other (DATA) connected to receive data from the latch. The multiplexers each have four voltage level inputs in common. The static DC levels are applied to these inputs. These circuits are powered from a supply voltage $V_{DD}$ (typically +5 VDC) and $V_{SSH}$ (variable according to temperature, LCD type, and matrix size). In the MSM 5260, $V_{DD}$ also serves as one of the static DC reference voltage inputs (V1). The FR input is conventionally inverted in a 50% duty cycle, typically once per frame but, in some implementations, as often as once per line, to select between pairs of the static voltage inputs.

For a number of reasons, conventional driver circuitry of the type used for twisted nematic liquid crystal displays is not satisfactory for ferroelectric liquid crystal displays. In ferroelectric displays, it is necessary to have bi-stable latching, that further has some threshold. In an actual matrix device there will always be some background voltages present at every pixel. It is important that these voltages not lower the contrast or change the state of a pixel but, on the other hand, that only a slightly greater voltage suffices to change the state of the pixel.

Another concern has to do with the nature of the electrical waveforms to be applied to the ferroelectric display device. The response of the device is dependent on the polarity of the applied voltage and on the product of the voltage and the duration of the applied pulse. In a ferroelectric device, a "+" polarity pulse switches a pixel to one state and a "−" pulse to the other. There is a threshold associated with this process that is, roughly speaking, related to the area under the pulse. Sub-threshold pulses (those that do not cause switching), however, can disturb the pixel. That is, while the pulse is applied, the director configuration distorts. In a matrix device, strobe waveforms will be applied to transparent conductive rows on one cell surface, and data waveforms to columns on the other surface. Waveforms applied to the rows and columns of the device produce a difference waveform from a particular row and column at each pixel. This difference waveform needs to be +V or −V during each time frame to set the selected pixels in a desired state. The rest of the time, the difference waveform should do nothing to the pixels. The data signals should affect only the strobed row, setting the pixels in that row ON or OFF while leaving the pixels in non-strobed rows unchanged. The rows are strobed sequentially so that a pixel sees the resultant of a strobe waveform and the data waveform for 1/N of the time (N=total number of matrix lines) and sees the data voltage alone for the rest of the time.

It turns out that a continuously-applied DC voltage, even if it is quite small, can affect the pixels' state. Thus, another requirement for ferroelectric liquid crystal display devices is that the background voltage be "AC-like."

Lagerwall et al., in the Proceedings of the 1985 International Display Research Conference, IEEE, pages 213–221 (1985), have proposed a five-phase bipolar drive waveform to meet these needs (see Lagerwall et al., FIG. 7). It requires that each row be addressed five times in a frame cycle: once to switch pixels in a row "up"; once to cancel the DC component of the first switching pulse; once to switch pixels in the row "down"; once to cancel the DC component of the third switching pulse; and once more to further increase the AC nature of the resultant waveform. Looking at the resultant waveforms, it can be seen that an "up" signal really goes "down-up" and a "down" signal really goes "up-down." Also, the data voltage waveform has "+" pulses followed by "−" pulses and vice versa to minimize the effect of the "background" voltage each pixel sees by making it more "AC" like.

There are two objectionable features to the Lagerwall et al. waveform. One problem is that the black area of the screen may tend to flicker if the refresh rate is slow. This is because black pixels will momentarily flash white during each refresh cycle. The other problem is that the refresh cycle will tend to take a lot of time because each row must be addressed with a five-phase sequence, where each phase interval is roughly equal to the switching seed of a pixel. Thus, if a pixel can be switched in 100 microsecs, 500 microsecs per line is required for every frame update of matrix device.

More recent results of an attempt to produce a ferroelectric matrix display device were presented in the paper, "Optimum Bias Condition for Multiplex Driving of the Chiral Smectic C LCD", Japan Display '86, pp. 460–462 by S. Shimoda et al. from Seiko Instruments. FIG. 1 gives the resultant voltages that an ON pixel sees (pixel-1) and that an OFF pixel sees (pixel-2). The waveform that each pixel sees is an alternately-polarized squarewave, is symmetric about a zero DC voltage level, has a period T, and uses three voltage magnitudes $V_S > V_N > V_H$. Only magnitude $V_S$ is intended to change the display state of the pixels, the state being determined by the polarity of the last-occurring pulse of magnitude $V_S$ ($-V_S$=ON, $+V_S$=OFF). In practice, however, this type of waveform produces very low display contrast, as is apparent from the transmission characteristics shown in FIG. 3 of the paper. It can be seen from the bottom half of FIG. 3 that the light transmission of a pixel that is ON (left half) is not much different from a pixel in the OFF state (right half).

Aside from the fact that the ferroelectric display drive waveform of Shimoda et al. provides a very low contrast ratio between the ON and OFF states, the waveform has other undesirable features. One is the that the pixels will tend to flicker when switched to OFF or black, especially if the addressing time of the display is greater than 20 ms. A second is that the pixels of a given column will have an average light transmission that is dependent on the state of the rest of the pixels in the column. Another undesirable feature is the time required to completely address the proposed matrix display device. In large displays, it would clearly be of use to reduce the time required to address the display by using some other waveform.

Other driving methods have been proposed for ferroelectric liquid crystal displays but these do not adequately address the concerns outlined above. U.S. Pat. No. 4,638,310 to Ayliffe discloses a method for addressing a ferroelectric liquid crystal matrix display which applies strobing pulses serially to the electrodes on one side of the display and applies balanced bipolar data pulses in parallel to the electrodes on the other side. The data pulses are twice as long as the strobing pulses.

U.S. Pat. No. 4,645,303 to Sekiya et al. discloses a liquid crystal matrix display panel drive method that appears to be directed to driving twisted nematic-type LCDs. It discusses how the effective RMS value (of concern in TN-type LCDs which are not bistable) of the drive voltage applied to the display element can be affected by the states of other elements driven by a common conductor. It proposes a drive scheme which seeks to eliminate pattern-dependent contrast effects in large-area displays which result from matrix conductor resistance and display element capacitance, and flickering if it is ensured that the duration of each cycle interval is shorter than the response time of the liquid crystal. Thus, Sekiya, et al. does not address the principal problems attendant to driving ferroelectric matrix displays.

U.S. Pat. No. 4,548,476 to Kaneko proposes a time-sharing driving method that employs a two-level drive scheme. This patent does not address the problems of complex multiplexing, as set out above, in a large (i.e., $M \times N$ where both M and N are typically greater than $2^6$) matrix display.

U.S. Pat. No. 4,508,429 to Nagae et al describes a method for controlling a switch for producing a two-level waveform ($+V_p$ and $-V_p$) and DC-offset variations thereof to switch and periodically refresh the state of the liquid crystal, in a scheme that provides an average voltage level of zero. The method does not provide for a multitude of levels and durations, however, because it does not involve bi-stable liquid crystals. Also, the form of drive circuit disclosed would, apparently have to be duplicated for each row and column of the matrix. This is not a practical solution for a large matrix display.

In summary, the lack of "good" bi-stability of the ferroelectric display elements and of desirable characteristics of the applied waveforms has inhibited the development of high resolution ferroelectric liquid crystal matrix devices. Accordingly, a need remains for a suitable drive waveform for driving a bi-stable ferroelectric liquid crystal matrix display.

SUMMARY OF THE INVENTION

The present invention provides a new set of matrix waveforms for driving chiral smectic C (SmC*) and other ferroelectric matrix display devices. The waveforms are characterized in that the data waveforms are bipolar AC waveforms that contain a "space." Further, these waveforms are $3 \times T_M$ in length, which I have found to be optimum. The resultant waveform applied to an ON pixel of a ferroelectric matrix display provides a very high display contrast relative to OFF pixels and, applied to an OFF pixel, does not cause that pixel to be pulsed white, which gives the characteristic of a flicker free matrix device. The transmission characteristics of a given pixel in a column are independent of the displays states of the other pixels in the column. And the waveform of the invention reduces the time required to address the display from the times required by the Lagerwall and Shimoda waveforms.

A first aspect of the invention is a method for driving a ferroelectric matrix display having a set of N parallel row conductors and an opposed set of M parallel column conductors, mutually oriented so that intersections of the row and column conductors define $M \times N$ pixels in the matrix display, the pixels being individually switchable between at least two stable display states. A strobe waveform is applied serially to each row conductor and a data waveform is applied to each column conductor. Typically, the strobe waveform includes a select state and a non-select state. The select state of the strobe waveform is applied serially to each row (for a time interval proportional to the ratio 1/N) to define said first interval for each row. The non-select state is applied to each row the rest of the time to define the second interval. The second interval recurs $N-1$ times for each occurrence of the select state in each row.

During each interval the row and column waveforms have a resultant waveform that switches sequentially among three single levels for all pixels in each row.

During a first time interval, a first pixel in the strobed row has a first resultant waveform defined sequentially by a first level that turns the pixel OFF, a second level that does not change the state of the first pixel, and a third level that turns the first pixel ON. Meanwhile, a second pixel in the row has a second resultant waveform defined sequentially by a fourth level that turns the second pixel OFF, and fifth and sixth levels that do not change the state of the second pixel. The first, third and fourth levels have a magnitude greater than the magnitude of the second, fifth and sixth levels and the first and fourth levels have a polarity opposite that of the third level. Other pixels in the strobed row can be kept unchanged by applying to them a waveform such as that which is next defined.

During a second time interval, the row and column waveforms have a resultant waveform that switches sequentially among three levels including seventh and eighth levels that are opposite in polarity and a ninth level between the seventh and eighth levels so as to produce a net DC component substantially equal to zero in the second interval. The seventh, eighth and ninth levels have a magnitude less than the magnitude of the first, third and fourth levels such that the display state of each pixel in a row remains unchanged during the second time interval.

In accordance with a second aspect of the invention, the three-phase, three-level waveform can be implemented using circuitry of the type used in driving conventional nematic-type liquid crystal displays. The fixed voltages normally used with such drivers are replaced with multi-phase waveforms. Then, the data bit can select one of two waveforms rather than fixed voltage levels to produce row and column select and non-select waveforms the resultants of which are the three-phase, three-level waveforms of the invention.

A liquid crystal display according to the invention includes row and a column driver circuit means for driving the rows and columns, respectively, of the array. These circuit means can be provided by conventional twisted-nematic LCD integrated circuit drivers. Each such driver includes at least two drive level inputs (four in most conventional drivers), at least two logical selection inputs, and a plurality of outputs connected to control lines of the display elements for switching the display elements between display states. A display controller means is connected to the logical selection inputs for controllably connecting the display to a graphical data source to control selection of display states of the display elements. A waveform generator means, having at least two outputs, is connected via each output to one of the drive level inputs for applying a predetermined time variant signal to the driver circuit means to cause them to output row and column waveforms having said three-phase, three-level resultant.

The waveform generator means preferably includes timing and switching means for generating at least two predetermined waveforms defining the time variant signal and providing each of said waveforms as an output signal through output buffer means to the two drive level inputs. The timing and switching means is operative to switch at least one of the waveforms among three predetermined levels. The output buffer means are arranged to provide a gain and output level within a predetermined dynamic range, within the safe operating limits of the driver circuit means and sufficient to enable the driver circuit means to actuate the display elements for switching between said two states. These drive level conditions are satisfied, for the row drivers, when $V_{SSH}<V4<V1<V_{DD}$ and, for the column drivers, when $V_{SSH}<V3<V2<V_{DD}$, where $V_{SSH}$, V1, V2, V3 and V4 are variable waveforms obtained by switching among predetermined static reference voltage inputs to the driver circuit. The output buffer means each have a low impedance output.

The controller means preferably includes timing means for generating a timing signal output to the driver circuit means for synchronizing the logical selection of the display elements. The timing and switching means correspondingly includes at least one input connected to receive the timing signals from the controller means and phase timing means responsive to the timing signals for synchronizing the waveform to a predetermined phase with the logical selection of the display elements. The timing and switching means can be provided by a 4:1 analog multiplexer having select means responsive to the timing signals for selecting among sets of four input reference voltages.

The foregoing and other objects, features and advantages of the invention will become more readily apparent from the following detailed description of a preferred embodiment which proceeds with reference to the accompanying drawings.

DETAILED DESCRIPTION

Analysis of Waveform Drive Schemes

Preliminary to describing the invention, it may be helpful to analyze the drawbacks of prior waveform drive schemes in further detail, and to develop a set of basic requirements for a ferroelectric matrix display drive scheme. This analysis proceeds with reference to the Shimoda et al. (Seiko) drive scheme, which represents the latest development in the art.

At a voltage, say $V_S$, there is a minimum pulse width $T_M$ that will be required to switch a pixel to a desired state. Referring to FIG. 1 of Shimoda et al., it can be seen that the time interval $T_{SI}$ must be at least twice $T_M$. In the Seiko matrix addressing scheme, a row needs to be accessed twice to set each pixel in the desired states (1st frame and 2nd frame), and each time it must be accessed for a time interval $T_{SI}$. So to completely address a display of N rows will require a time equal to $4T_MN$.

To make clear the other problem with the Seiko waveform, consider the data waveforms used to generate the resultant waveforms of FIG. 1. A select data waveform will need to look like that shown in FIG. 1A of the accompanying drawings (a transition from $+V_D$ to $-V_D$), while a non-select waveform needs to look like that shown in FIG. 1B (a transition from $-V_D$ to $+V_D$).

Figure 1A:
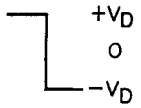
FIGS. 1A through 1J show segments of waveforms used to derive the three-phase, three-level drive waveform scheme of the present invention, shown in FIGS. 1E through 1J.
Figure 1B:
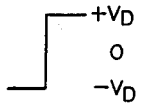
Figure 1C:
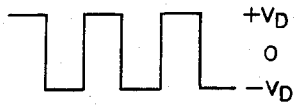
Figure 1D:
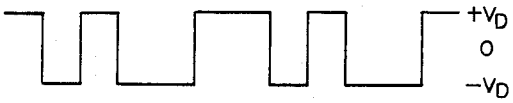
Figure 1E:
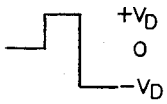
Figure 1F:
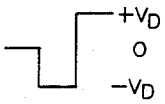
Figure 1G:
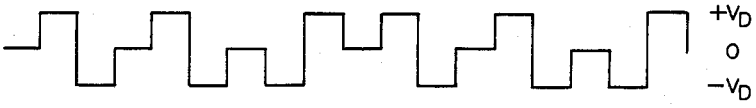

If every pixel in a column is selected ON, the voltage applied to that column would be as shown in FIG. 1C (bipolar alternating squarewave of $2V_D$ peak-to-peak amplitude) and a pixel would see resultant waveforms similar to those of FIG. 1 of Shimoda et al. But if every third pixel in the column were non-selected OFF, the waveform would be like that shown in FIG. 1D, with alternating pairs of short ($T_M$ duration) and long ($2T_M$) pulses of opposite polarity. Note that, in this case, there are intervals where a given voltage level is held for twice as long as in the former case. This causes a problem. As mentioned earlier, the ferroelectric display elements react to the product of a pulse's voltage and duration. So pixels in a given column will have an averaged light transmission highly dependent on the state of the rest of the pixels in that column. This reduces contrast and does so non-uniformly from one column to the next. This is also a problem with the Ayliffe waveforms.

Yet another difficulty with this waveform is that pixels which are to be OFF or black are seen to be pulsed ON for a short time during the addressing sequence. If the addressing time of the display is greater than 20 ms, an objectionable flicker will result. This is also a problem with the Lagerwall et al. waveforms.

In a 1000 line display a pixel will see the difference between the select strobe waveform and the data waveform 1/1000 of the time. During this interval the state of the pixel (ON or OFF) is determined. During the remainder of the time (999/1000) a pixel will have applied to it the voltages that are the difference between the non-select strobe waveform and the data waveform.

Three-phase, Three-level Drive Waveform

Of the four waveforms (select strobe waveform, non-select strobe waveform, select data waveform and non-select data waveform) discussed so far, one of them can be defined as the reference waveform and set to be a constant zero volts. It is convenient to set the non-select strobe waveform to zero. Then, in a 1000 line display, a pixel will see a voltage equal to the data waveform applied to its column 999/1000 of the time.

Because the data waveforms are what a pixel sees most of the time, they need to possess some minimum characteristics. One thing is that they must contain no net DC component as a continuously applied DC voltage yields undesirable results (due to ionic double layers and or electro-chemical effects). The data waveforms of the Seiko paper and Ayliffe have this characteristic, that is, both the select and non-select data waveforms are balanced bipolar.

The second minimum characteristic is that combinations of the select and non-select waveforms should not produce variable length pulses, as does the Seiko waveform. This characteristic can be had by having data waveforms that contain a "space." For example, consider the waveforms shown in FIG. 1E and 1F. Combinations of these waveforms cannot produce pulses of different widths. A column in which every third pixel is OFF would have applied to it the waveform shown in FIG. 1G.

Figure 1H:
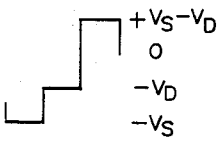
Figure 1I:
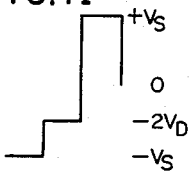
Figure 1J:
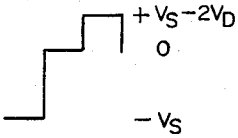

The select strobe waveform can be, for example, that shown in FIG. 1H. That waveform, when combined with the select data waveform, will yield a resultant voltage for an ON pixel as shown in FIG. 1I (pixel 2,2 in FIG. 5). When combined with the non-select data waveform, it will yield a resultant voltage for an OFF pixel as shown in FIG. 1J (pixel 1,1 in FIG. 5). The voltages are chosen so that $V_S$ is a voltage level sufficient for the chosen pulse width to switch the display element, and the voltage $V_S-2*V_D$ is small enough not to permanently alter the state of the element.

The use of a select strobe waveform of this type in conjunction with the proposed data waveforms has the feature that while ON pixels will be momentarily pulsed black, OFF pixels will not be pulsed white. This allows the use of frame times longer than 20 ms (probably necessary for large displays) without causing the flicker problem referred to in the previous section.

Figure 5:
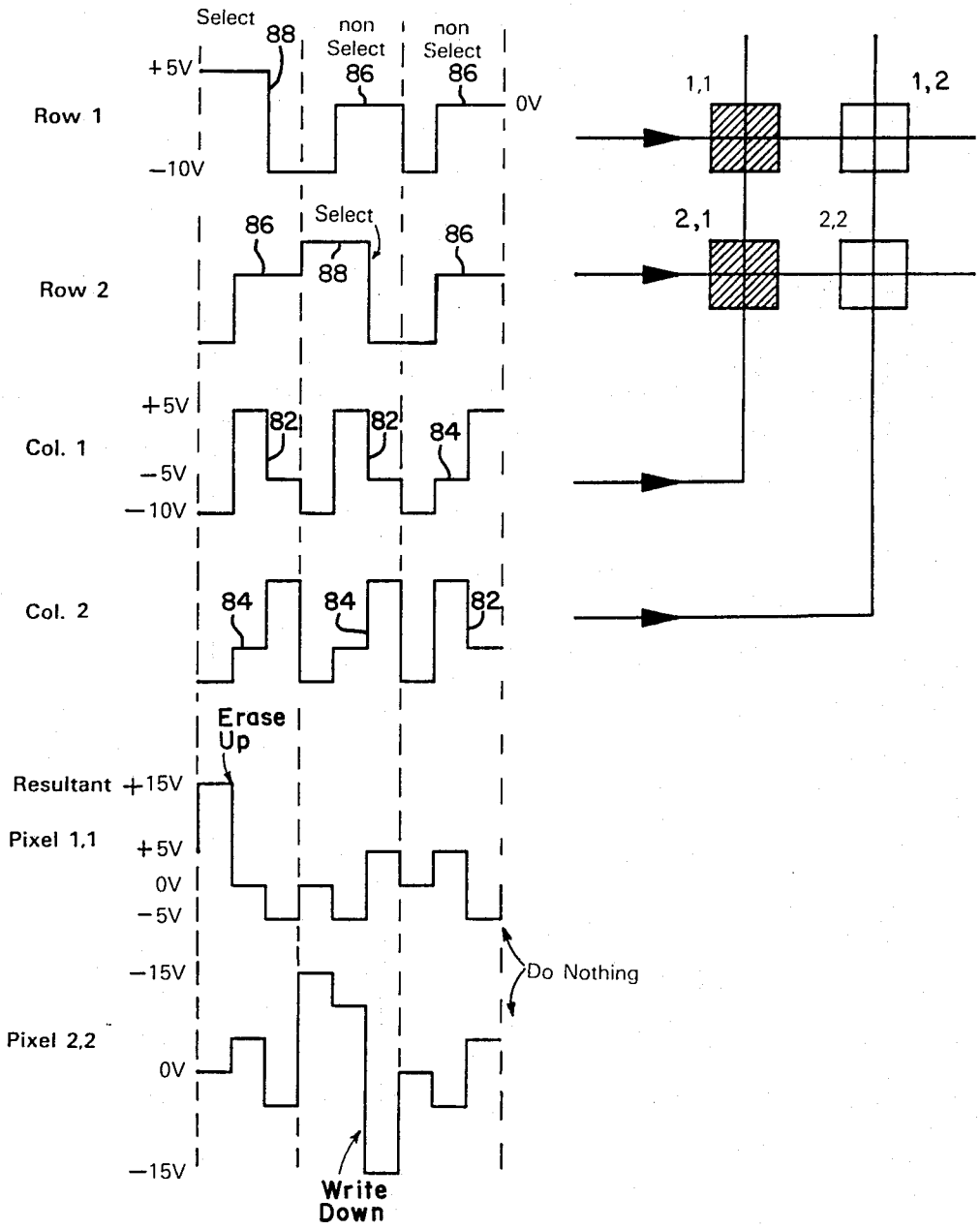
FIG. 5 is an output waveform diagram for the three-phase, three-level drive scheme of the invention.

In FIG. 5, the select and non-select waveforms for the rows and columns are diagramed, in inverted form, together with their resultants, and the response of the affected pixels is shown. Each of the row and column waveforms varies through three levels. Analyzing the resultants, during each strobe interval (demarcated in dashed lines), each of the resultant waveforms varies through three levels in three phases of equal duration. When the first row is selected, a first pixel (1,1) is subjected to a first level that turns it OFF (erase up) and then to second and third levels that do not affect the pixel. The second pixel (1,2) is turned ON (write down) by a resultant waveform that includes a first level which turns the pixel OFF, a second level of lesser magnitude, and a third level that turns the pixel ON (write down). When the second row is selected, in a second time interval, pixels (2,1) and (2,2) are similarly switched. While row 2 is being addressed in the second time interval, the pixels of row 1 are subjected to three different resultant levels that have a net DC component of zero and each of which have a voltage-duration product that does not affect the respective display states of the pixels (1,1) and (1,2).

During the first interval, i.e., when row 1 is selected, the first level applied to pixel (1,1) and first and third levels applied to pixel (1,2) to change their respective states, have a magnitude greater than the magnitude of the second and third levels applied to pixel (1,1) and the second level applied to pixel (1,2). The first levels applied to both pixels (1,1) and (1,2) have a polarity opposite that of the third level applied to pixel (1,2).

The resultant levels applied to a row of pixels so as not to change their state during a strobe nonselect interval, e.g. pixels (1,1) and (1,2) during the second interval, have magnitudes less than the magnitudes of the first level applied to pixel (1,1) during the first interval and of the first and third levels applied to pixel (1,2). Two of these levels, preferably the second and third, are opposite in polarity and the remaining (e.g. the first) level has a magnitude such that the three levels together produce a net DC component substantially equal to zero. This requirement is easily satisfied by setting the first level equal to zero and the second and third levels equal and opposite in polarity. Other combinations of voltage levels, however, can meet the constraints defined above.

Figure 9:
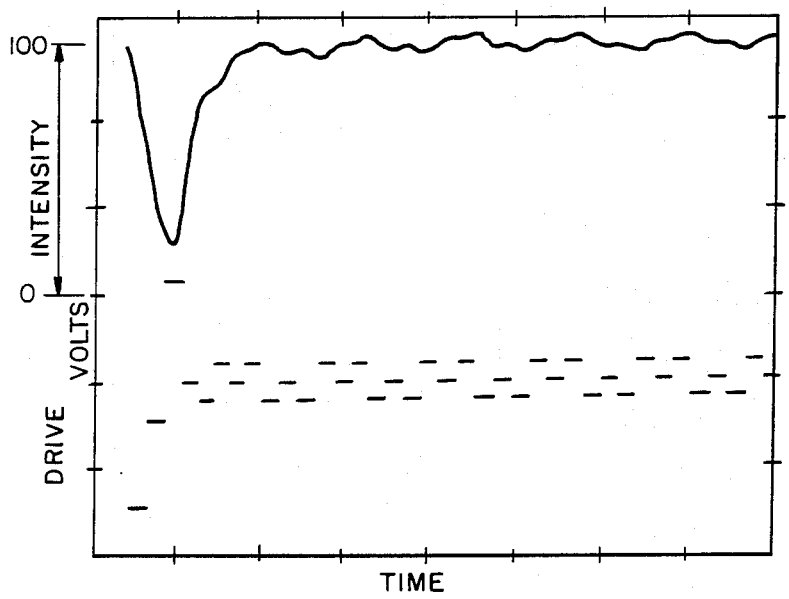
FIG. 9 is a tracing of an oscillograph showing the resultant drive waveform applied to a pixel in a ferroelectric LCD in accordance with the invention to switch the pixel to an ON state and the light transmission characteristics of the pixel produced in response to the waveform with the ferroelectric liquid crystal cell between cross polarizers and rotated so that the dark state (OFF) is minimum transmission.

Combining the select strobe waveform with a select data waveform and then a non-select strobe waveform repeatedly with data waveforms produces a resultant waveform as shown at the bottom of FIG. 9. This is the resultant waveform that an ON pixel would see in a matrix display. FIG. 9. also shows the corresponding light intensity transmitted by the display element of the "TM type." ("TM type" refers to the method of director alignment described in my co-pending U.S. Pat. application Ser. No. 07/038,567, filed Apr. 13, 1987, entitled Chiral Liquid Crystal Cell).

Figure 10:
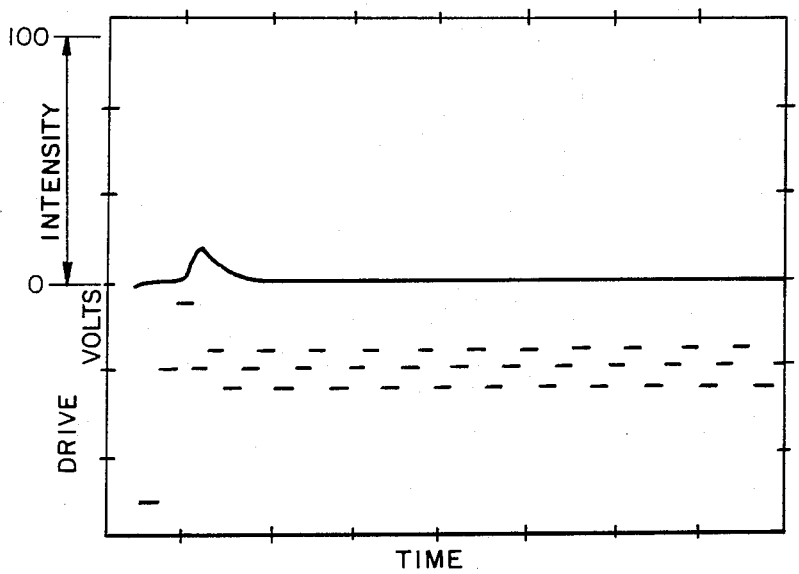
FIG. 10 is a tracing like FIG. 9 showing the resultant waveform and light transmission characteristic for the OFF state.

Combining the select strobe waveform with a non-select data waveform and then the non-select strobe waveform with the data waveforms produces a resultant waveform as shown at the bottom of FIG. 10. This is the resultant waveform that an OFF pixel would see in a matrix display. FIG. 10 also shows the light intensity transmitted by the display element.

With appropriate addressing, the waveform drive scheme is suitable for a 1000 line display device. As can be seen from the oscillograph tracings, the contrast ratio between an ON state and an OFF state is high. The improvement over the prior art is shown clearly by comparing FIGS. 9 and 10 with FIG. 3 in the Seiko paper. The described waveforms have an additional advantage over those described in the Seiko paper in that the time required to address the matrix display is $3 \times N \times T_M$ rather than $4 \times N \times T_M$.

The waveform drive scheme will work in any ferroelectric matrix display having a large enough number N of lines (rows) that a small net DC component arising from the select strobe interval is negligible. Throughout the $N-1$ non-select strobe intervals, the net DC component remains zero. The net DC component becomes non-negligible, and will noticeably degrade display contrast at fewer than 64 lines. Display quality will be essentially undegraded at $N > 100$.

Waveform Drive Circuitry

Figure 2:
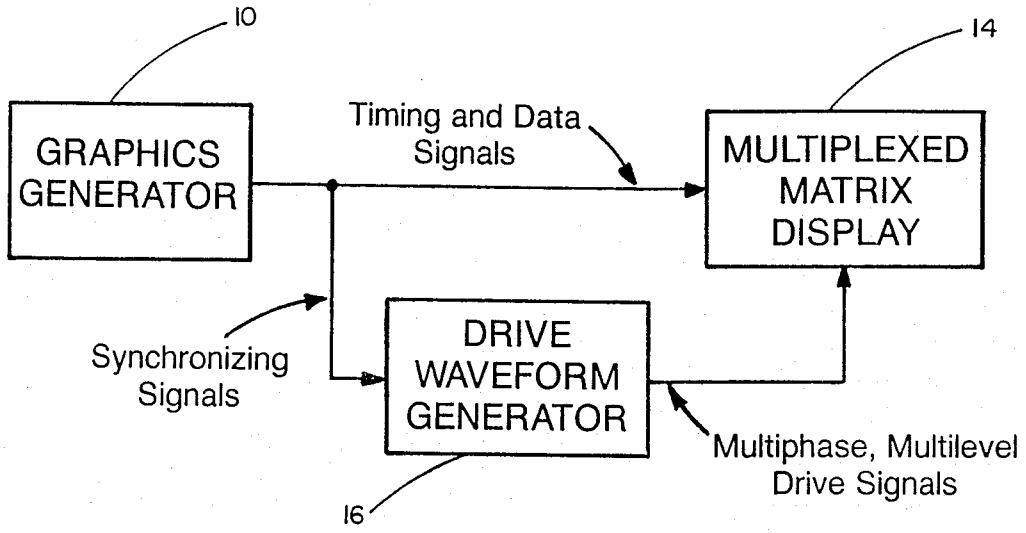
FIG. 2 is a block diagram of a computer-driven liquid crystal matrix display in accordance with the invention.

Referring to FIG. 2, a graphics generator 10 is connected to transmit timing and data signals to a multiplexed ferroelectric matrix display 14, driven by conventional drivers, in combination with a drive waveform generator 16. In general, synchronizing signals are extracted from the timing and data signals provided by the graphics generator to the matrix display, and synchronizing signals are input to the waveform generator. The waveform generator provides multiphase, multilevel drive signals, synchronized with the timing and data signals, to the matrix display drivers. This arrangement is further detailed in the functional block diagram of FIG. 3.

Figure 3:
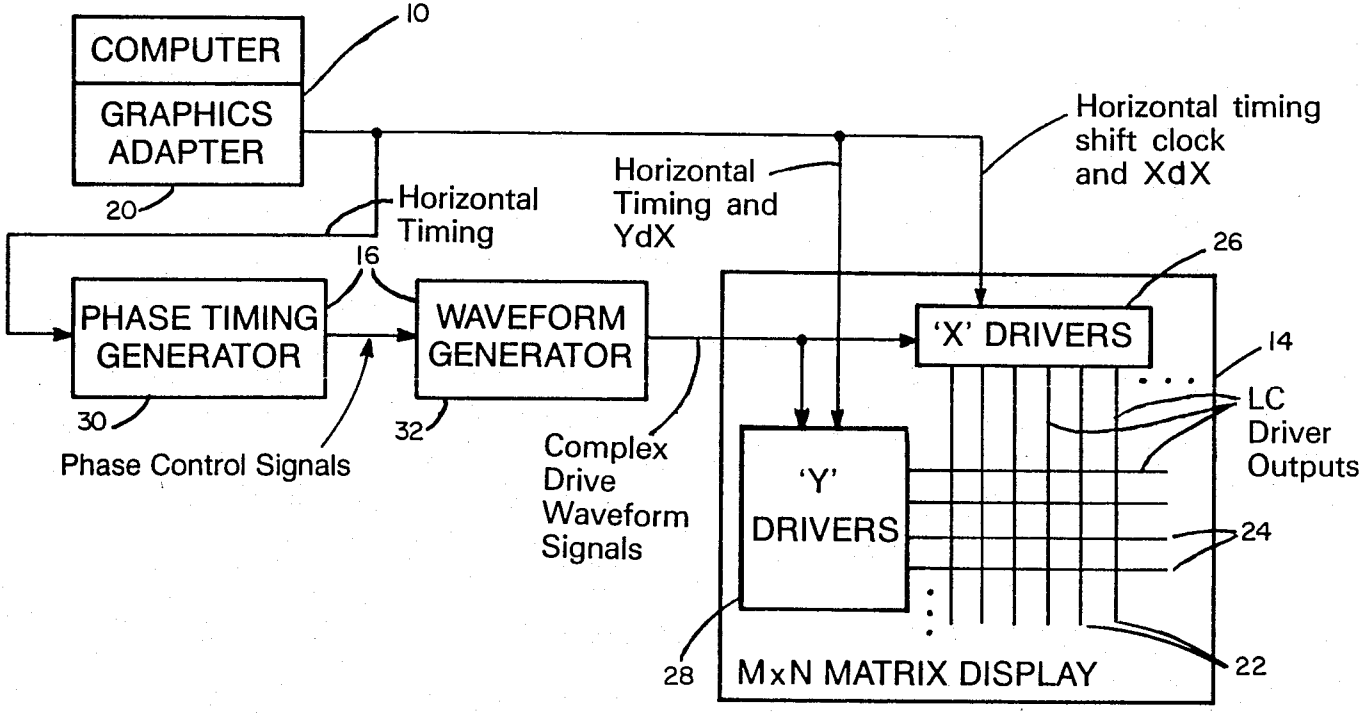
FIG. 3 is a more-detailed functional block diagram of a ferroelectric liquid crystal matrix display in accordance with the invention.

In FIG. 3, the graphics generator is provided by a computer 18 with a graphics adapter 20. Other forms of graphics generator can readily be used, such as a television receiver or video cassette recorder. In one operational implementation, the computer is provided by an IBM AT personal computer, having an IBM graphics adapter and an Epson video-to-LCD interface adapter. The interface adapter conventionally has 5 timing and data signal outputs: horizontal timing (YSCL), shift clock (XSCL), Y data (Ydx), raster X data (Xdx) and frame alternate (FR). The raster X data (Xdx) may be parallelized e.g, four bits at once, to reduce shift clock speed.

Display 14 is a ferroelectric matrix display comprising M rows and N columns, where M and N are typically greater than $2^6$. The structure of the matrix display can take any of a number of forms known in the art. Typically, such a display takes the form of a sandwich structure composed of a pair of transparent, rigid planar members closely spaced about a layer of ferroelectric material of predetermined thickness. A set of X or column electrodes are arrayed on one side of the display and a set of Y or row electrodes are arrayed on the opposite side of the display so as to intersect with each other to form a matrix of intersecting points. These electrodes are connected in turn to X and Y drivers 26 and 28, respectively. These drivers can be provided by any number of conventional drivers used in matrix type displays. In an example of the invention, further described hereinafter with reference to FIG. 4 and FIG. 7, the X drivers are provided by an Epson SED 1180 column driver and the Y drivers by an Epson SED 1190 row driver.

The X drivers 26 have, as inputs, the horizontal timing, shift clock and Xdx signals from graphics adapter 20. The Y drivers 28 receive, as inputs from the graphics adapter, horizontal timing and Ydx signals. Additional inputs to the X and Y drivers 26, 28 are provided in accordance with the invention, as next described.

The driver waveform generator 16 includes two functional elements. A phase timing generator 30 receives horizontal timing signals from graphics adapter 20 and outputs phase control signals. These phase control signals are input to waveform generator 32, which provide logic and complex drive waveform signals to the X and Y drivers 26, 28. The phase timing generator 30 is shown in further detail in FIG. 8 and the waveform generator 32 is detailed in FIG. 4.

Figure 8:
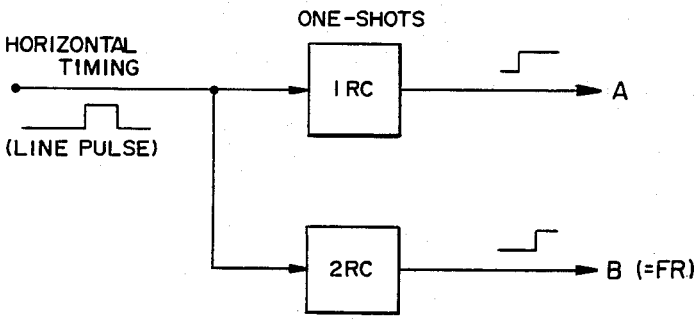
FIG. 8 is a block diagram of the timing generator and decoder of FIG. 4.

Referring first to FIG. 8, the timing generator receives horizontal timing signals in the form of a synchronization pulse that occurs once during each raster line of X data (Xdx). The timing generator produces a number of phase control signals. These signals serve two functions. First, they serve to establish a predetermined phase relationship with the horizontal timing signal and thereby synchronize the complex drive waveform signals output from the waveform generator with the X and Y data input to the drivers. Second, they provide switching control signals which occur several times during each raster line of X data.

The timing generator can take a number of forms. In one operative example, it is implemented by two fixed-time, one-shot circuits 34, 36 to provide the three-phase waveform signals described above. The same function could be performed digitally using the shift clock signal as an input in addition to the horizontal timing, to generate the phase control signals; thus changing with the phase control signals with the frame rate.

Figure 4:
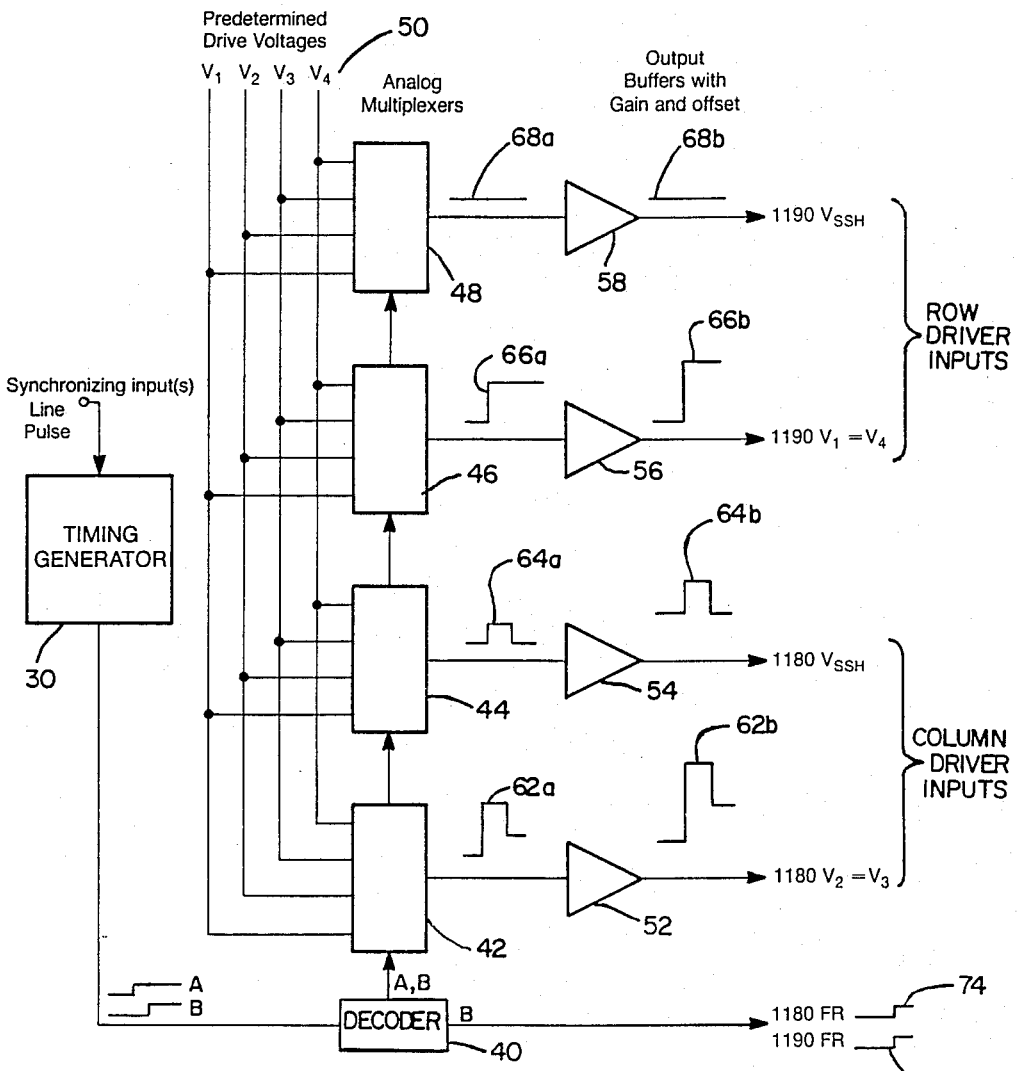
FIG. 4 is a block diagram of the waveform generator circuit for implementing the display of FIG. 3.

Referring to FIG. 4, the phase control signals are input to a decoder 40. The decoder, in turn, provides outputs that are connected to SELECT inputs of four analog multiplexers 42, 44, 46, 48. For the three-phase waveform of the present invention and the form of timing generator shown in FIG. 8, the decoder can simply be direct connection of the two phase control signals to the appropriate multiplexer inputs. Each of the multiplexers is a 4:1 multiplexer having four inputs connected to predetermined drive voltages V1, V2, V3 and V4, and a single output. The output of each multiplexer is connected to a buffer amplifier, 52, 54, 56, 58, respectively. The outputs of these buffers are then provided as row and column driver inputs to the Y and X drivers 28, 26 of display 14.

Figure 6:
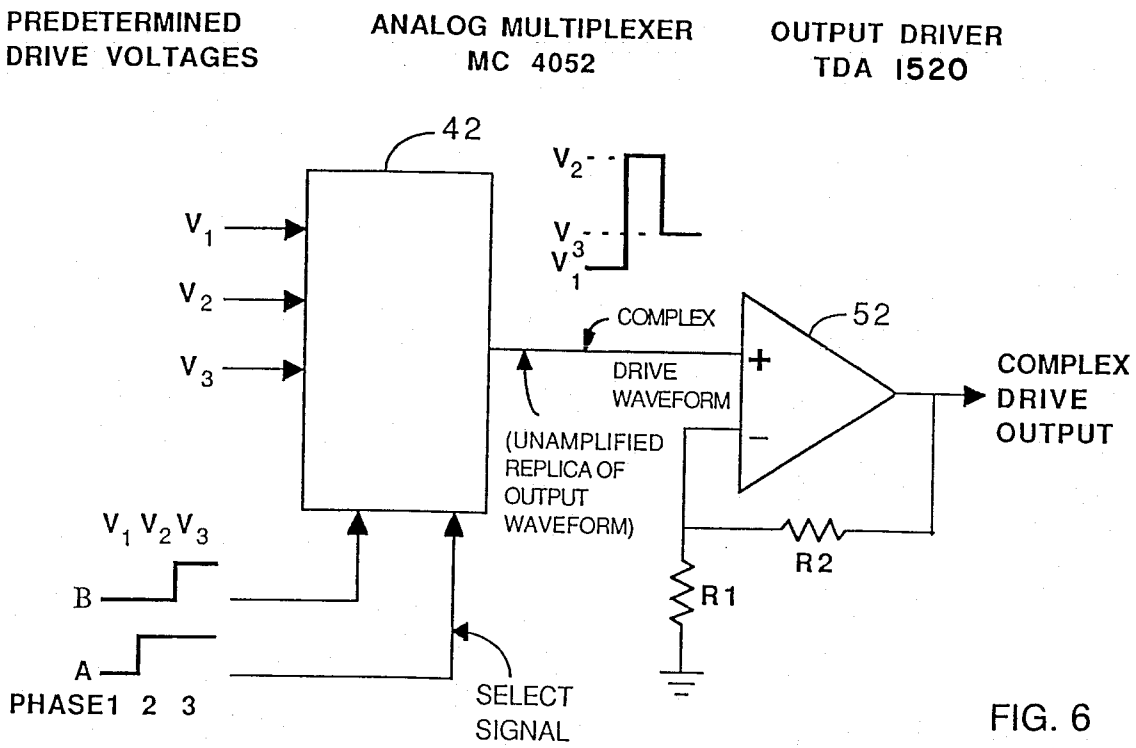
FIG. 6 is a schematic of an implementation of the waveform generator circuits of FIG. 4.

Referring to FIG. 6, an operational example of the waveform generator 32, is implemented with a Motorola model MC 4052 analog multiplexer and a Signetics model TDA 1520 output driver. The multiplexer has two SELECT inputs, each of which are connected to receive the three-phase control signals. A combination of phase control signals input to each multiplexer is logically chosen to produce a predetermined output waveform from each multiplexer, shown as waveforms *62a, 64a, 66a,* and *68a* in FIG. 7. When these waveforms are input to the output buffers, they are output to the X and Y drivers in a form that replicates the input waveform shape and timing but with a different gain and offset, as needed for the particular form of drivers. The drivers used in the above-mentioned example have a 27 volt range, which condition is readily met in the example by output waveforms which vary over a 15 volt range in 5 volt steps from −10 volts to +5 volts (see FIG. 7).

Besides the above-described row and column driver inputs, the waveform generator (FIG. 4) provides two "FR" signals to the row and column drivers. Conventional twisted nematic type drivers have a frame alternate (FR) input which, in conventional usage, is connected to the corresponding "FR" output of graphics adapter 20. That output, which is not used in the present invention, is a logic signal with a 50% duty cycle. Typically, this logic signal is switched once each frame and in some conventional implementations is switched as often as once per raster line of X data. In accordance with the invention, this input to the X and Y drivers is switched at least once within each raster line of data. Accordingly, for the X drivers, during each raster of X data (Xdx) the FR signal 72 is normally low for a portion (first two-thirds) of the raster line time interval, then switches to a high state for the remainder (one-third) of that interval. The FR signal 74 input to the Y driver conveniently can have the same form in the illustrated implementation.

Figure 7:
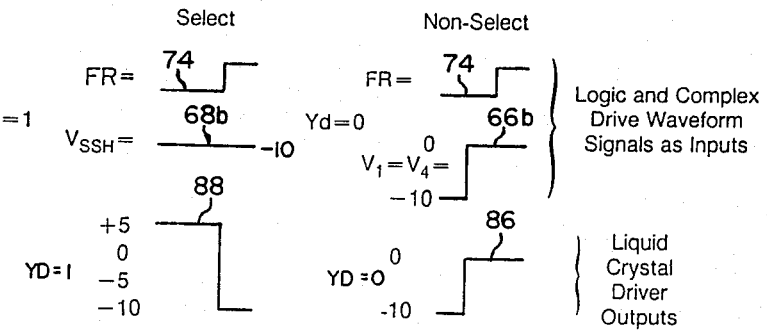
FIG. 7 is a set of input/output diagrams for the driver implementation of FIG. 4 to produce the output signals of FIG. 5.
Figure 7:
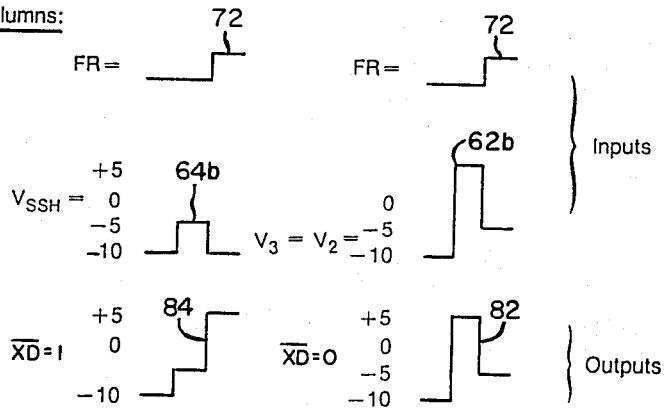

FIG. 7 illustrates how the row and column driver waveforms of FIG. 5 are developed in accordance with the invention. The FR signal 74 is applied to the row driver for both the selected and non-selected rows. Waveform *68b* is applied to the selected rows and waveform *66b* to the non-selected rows. Similarly, FR signal 72 is applied to the column driver FR input for both the selected and non-selected displays. Waveforms *64b* and *62b* are alternately applied to the inputs of the column as required to select or non-select each respective column. The resultant driver outputs are illustrated for each of the input waveforms. Output waveform 82 corresponds to input waveform *62b* and output 84 corresponds to input *64b*, for the columns. Similarly, the non-select output 86 corresponds to input *66b*, and the select output 88 corresponds to input *68b* for the row drivers. The left portion of FIG. 7 shows the logic tables that determine the form of output signals 82, 84, 86 and 88. The resultant waveforms applied to each pixel are the algebraic difference between the row and column waveforms at each intersection of the row and column electrodes.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A method for driving a ferroelectric matrix display having a set of N parallel row conductors and an opposed set of M parallel column conductors, mutually oriented so that intersections of the row and column conductors define M×N pixels in the matrix display, the pixels being individually switchable between at least two stable display states, the method comprising:

applying a strobe waveform serially to each row conductor, each such waveform being applied during one of a plurality of sequential strobe time intervals, applying a data waveform to each column conductors;

controlling the row and column waveforms to produce a resultant waveform during a first strobe time interval that switches sequentially among three and only three levels and through three and only three phases for all pixels in a row;

a first pixel in the row having a first resultant waveform defined sequentially by a first level that turns the pixel OFF, a second level that does not change the state of the first pixel, and a third level that turns the first pixel ON;

a second pixel in the row having a second resultant waveform defined sequentially by a fourth level that turns the second pixel OFF, and fifth and sixth levels that do not change the state of the second pixel;

the first, third and fourth levels having a magnitude greater than the magnitude of the second, fifth and sixth levels;

the first and fourth levels having a polarity opposite that of the third level;

controlling the row and column waveforms to produce a resultant waveform during a second strobe time interval that switches sequentially among three levels including seventh and eight levels that are opposite in polarity and a ninth level between the seventh and eighth levels so as to produce a net DC component substantially equal to zero in the second interval;

the seventh, eighth and ninth levels having a magnitude less than the magnitude of the first, third and fourth levels such that the display state of each pixel in a row remains unchanged during the second time interval.

2. A method according to claim 1, in which each strobe time interval is proportional to the ratio 1/N.

3. A method according to claim 2, in which the strobe waveform includes a select state and a nonselect state, the select state of the strobe waveform being applied serially to each row to define said first strobe time interval for each row, and the non-select state being applied to each row to define the second strobe time interval, the second strobe time interval recurring N−1 times for each occurrence of the select state in each row.

4. A method according to claim 3, in which N is sufficiently large that a net DC component during the select state is negligible when averaged over N intervals.

5. A method according to claim 4, in which N is at least 100.

6. A method according to claim 2, in which $N>2^6$.

7. A method according to claim 1, in which each of said levels has a duration Tm, the first, third and fourth levels having a magnitude-duration product sufficient to change the state of a pixel.

8. A method according to claim 7, in which the second and sixth through ninth levels differ among at least three levels.

9. A method according to claim 7, in which the second and sixth through ninth levels differ such that the magnitude-duration product thereof minimally affect the state of the pixels.

10. A method according to claim 1, in which each of said levels has a duration Tm and differ so that for each pixel the resultant level changes for each duration Tm, whereby no pixel has a constant level for a duration of 2 Tm.

11. The method of claim 1 wherein the strobe waveform has a maximum magnitude of $V_S$ and wherein the row and column waveforms are controlled to produce resultant waveforms in which the maximum magnitude of the first, third and fourth levels is less than or equal to $V_S$.

12. The method of claim 11 wherein the data waveform has a maximum magnitude of $V_D$ and wherein the maximum magnitude of the sixth level is less than or equal to $V_S-2*V_D$.

13. The method of claim 1 wherein the first and second resultant waveforms include a net D.C. component.

14. The method of claim 1 wherein each of the three phases is of equal duration.

15. A ferroelectric liquid crystal display comprising:

a matrix display panel having a two-dimensional array of ferroelectric liquid crystal display elements switchable between at least two display states under control of opposed, intersecting sets of row and column control lines;

row and column driver circuit means, each driver circuit means having at least tow drive level inputs, a logical selection input, and a plurality of outputs connected to the respective row and column control lines of the display elements, for switching the display elements between said display states;

display controller means controllably connected to the logical selection input for connecting the display to a graphical data source to control selection of display states of the display elements; and waveform generator means having at least two outputs, each output being connected to one of the drive level inputs for applying a time variant signal to the driver circuit means such that the driver circuit outputs provide strobe and data waveforms on the row and column control lines, respectively, which produce a resultant waveform to each display element that varies among three and only three signal levels and through three and only three phases during selection of the display states for one row of display elements and which includes a net D.C. component;

said waveform generator means having an input connected to receive a timing signal from the controller means.

16. A display according to claim 15 in which the waveform generator means includes:

timing and switching means for generating at least two predetermined waveforms and providing each of said waveforms as an output signal; and at least two output buffer means, each having one of said waveform output signals as an input, for inputting each of said waveforms to a different drive level input.

17. A display according to claim 16 in which the output buffer means are arranged to provide a gain and output level within a predetermined dynamic range sufficient to enable the column driver circuit means to actuate the display elements for switching between each display state.

18. A display according to claim 16 in which the output buffer means are arranged to provide a gain and offset drive level for the time variant drive signals such that the conditions $V_{SSH}<V4<V1<V_{DD}$ for the row drivers and $V_{SSH}<V3<V2<V_{DD}$ for the column drivers are satisfied, where $V_{SSH}$, V4, V3, V2 and V1 are variables defining said predetermined waveform signals and $V_{DD}$ is a reference voltage.

19. A display according to claim 16 in which:

the display controller means includes timing means for generating a timing signal output to the driver circuit means for synchronizing the logical selection of the display elements; and the timing and switching means includes at least one input connected to receive the timing signal output from the controller means and phase timing means responsive to the timing signals for synchronizing the waveform to a predetermined phase with the logical selection of the display elements.

20. A display according to claim 16 in which the timing and switching means is operative to switch at least one of the waveform output signals at least three predetermined levels.

21. A display according to claim 15 in which the controller means includes timing means for generating a timing signal output to the driver circuit means for controlling the logical selection of the display states of the display elements and the waveform generator means includes means responsive to the timing signal for synchronizing the data waveforms with the strobe waveforms for logical selection of the display elements in accordance with said resultant waveform.

22. A display according to claim 15 in which the waveform generator means is operative to vary the data waveforms through three phases and among three levels in a predetermined sequence in synchrony with the strobe waveforms.

23. A display according to claim 15, in which the waveform generator means is operative to cause the drive circuit means to vary said resultant waveform such that, in a first time interval in which a select strobe waveform is applied to a row, the selected row includes:

a first pixel having a first resultant waveform defined sequentially by a first level that turns the pixel OFF, a second level that does not change the state of the first pixel, and a third level that turns the first pixel ON; and a second pixel having a second resultant waveform defined sequentially by a fourth level that turns the second pixel OFF, and fifth and sixth levels that do not change the state of the second pixel;

the first, third and fourth levels having a magnitude greater than the magnitude of the second, fifth and sixth levels the first and fourth levels having a polarity opposite that of the third level; and in a second time interval in which a non-select strobe waveform is applied to a row, the resultant waveform varies sequentially among three levels including seventh and eighth levels that are opposite in polarity and a ninth level between the seventh and eighth levels so as to produce a net DC component substantially equal to zero in the second time interval;

the seventh, eight and ninth levels having a magnitude less than the magnitude of the first, third and fourth levels such that the display state of each pixel in a row remains unchanged during the second time interval.

24. A display according to claim 23 wherein the strobe waveform has a maximum magnitude of $V_S$ and wherein the row and column waveforms are controlled to produce resultant waveforms in which the maximum magnitude of the first, third and fourth levels is less than or equal to $V_S$.

25. A display according to claim 24 wherein the data waveform has a maximum magnitude of $V_D$ and wherein the maximum magnitude of the sixth level is less than or equal to $V_S-2*V_d$.

26. A display according to claim 15 wherein the strobe waveform has a maximum magnitude of $V_S$ and wherein said waveform generator means is constructed and arranged to cause said driver circuit means to produce a resultant waveform having a maximum magnitude of less than or equal to $V_S$ for switching a display element between states.

27. A display according to claim 26 wherein the data waveform has a maximum magnitude of $V_D$ and wherein said waveform generator means is constructed and arranged to limit the maximum magnitude of each resultant waveform to less than or equal to $V_S-2*V_D$ after the display element is placed in a selected display state.

28. The display of claim 15 wherein each of the three phases is of equal duration.

29. A ferroelectric liquid crystal display for displaying data from a graphical data source, comprising:

a matrix display panel having a two-dimensional array of ferroelectric liquid crystal display elements switchable between at least two display states, under control of opposed, intersecting sets of row and column control lines;

row and column driver circuit means, each driver circuit means having at least two drive level inputs, logical selection input means for inputting signals from a graphical data source to control selection of display states of the display elements, and a plurality of row and column outputs connected to the row and column control lines, respectively, for switching the display elements between said states; and waveform generator means having at least two outputs, including a strobe waveform output connected to the drive level input of the row driver for serially applying a first time-variant signal having a maximum magnitude of $V_S$ to the row driver circuit means and a data waveform output connected to the drive level input of the column driver for applying a second time-variant signal having a maximum magnitude of $V_D$ to the column driver circuit means;

the waveform generator means including a timing and switching means for generating, as said second time variant output signal, predetermined data select and non-select waveforms which vary among three levels within a predetermined dynamic range through three phases in a predetermined sequence such that a resultant waveform is produced at each display element that varies among three and only three signal levels and through three and only three phases for each occurrence of the logical selection of the display state of the display elements;

wherein said timing and switching means includes an input connected to receive a timing signal from the graphical data source and is constructed and arranged to cause said driver circuit means to produce a resultant waveform having a maximum value of less than or equal to $V_S$ for switching a display element between states.

30. A display according to claim 29 in which the waveform generator means is operative to produce predetermined strobe select and non-select waveforms such that the resultant of the strobe non-select waveform and the data waveform output has a net DC component equal to zero.

31. A display according to claim 30, in which the resultant of the strobe select waveform and the data select waveform is a first level that turns a pixel OFF, a second level that does not change the pixel and a third level that turns the pixel ON.

32. A display according to claim 30 in which the resultant of the strobe select waveform and the data non-select waveform is a first level that turns a pixel OFF and second and third levels that do not change the pixel.

33. A display according to claim 29 wherein said waveform generator means is constructed and arranged to cause said row and column driver circuit means to produce a resultant waveform having a net D.C. component for switching the display elements between display states.

34. A display according to claim 29 wherein said waveform generator means is constructed and arranged to limit the maximum magnitude of each resultant waveform to less than or equal to $V_S-2*V_D$ after selection of the display state of the display elements.

35. The display of claim 29 wherein each of the three phases is of equal duration.

* * * * *